US006881095B2

(12) United States Patent
Murr et al.

(10) Patent No.: US 6,881,095 B2
(45) Date of Patent: Apr. 19, 2005

(54) SMALL FORM-FACTOR TRANSCEIVER MODULE WITH PULL-TO-RELEASE

(75) Inventors: Keith M. Murr, Etters, PA (US); Michael J. Phillips, Camp Hill, PA (US); Randall R. Henry, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/277,328

(22) Filed: Oct. 22, 2002

(65) Prior Publication Data

US 2004/0077226 A1 Apr. 22, 2004

(51) Int. Cl.[7] ..... H01R 13/648
(52) U.S. Cl. ..... 439/607
(58) Field of Search ..... 439/352, 357, 439/358, 607; 361/747, 754

(56) References Cited

U.S. PATENT DOCUMENTS

| | | | | |
|---|---|---|---|---|
| 6,335,869 | B1 | 1/2002 | Branch et al. | |
| 6,371,787 | B1 | 4/2002 | Branch et al. | |
| 6,430,053 | B1 * | 8/2002 | Peterson et al. | 361/728 |
| 6,434,015 | B1 * | 8/2002 | Hwang | 361/754 |
| 6,447,170 | B1 * | 9/2002 | Takahashi et al. | 385/53 |
| 6,485,322 | B1 * | 11/2002 | Branch et al. | 439/357 |
| 6,530,785 | B1 * | 3/2003 | Hwang | 439/76.1 |
| 6,570,768 | B1 * | 5/2003 | Medina | 361/747 |
| 6,612,858 | B1 * | 9/2003 | Stockhaus | 439/352 |
| 2001/0030855 | A1 | 10/2001 | Green et al. | |
| 2002/0025720 | A1 | 2/2002 | Bright et al. | |
| 2002/0068481 | A1 | 6/2002 | Flickinger et al. | |
| 2002/0072274 | A1 | 6/2002 | Flickinger et al. | |
| 2002/0093796 | A1 | 7/2002 | Medina | |

OTHER PUBLICATIONS

"Optical SFP Transceiver Modules", Finisar Corporation, Jun. 2000, FTRJ–8519–3/4, FTRJ–1319–3, no date.
"Small & Pluggable Metro Access Solution", Samsung Electronics, 2002, no date.
"ES063–LP2TA–x–y–z Preliminary Data Sheet", 3.3V Single–Mode LC SFP Transceiver For SONET OC–12/SDH STM–4, E2O Communications, Inc., Apr. 15, 2002, p. 1–5.
"LCP–1250A4KS Small Form Factor Pluggable Transceiver for Gigabit Ethernet", Delta Electronics, Inc., publication date unknown, p. 6, no date.
"1.062 and 2.125 Gbps SFP Shortwave Transceiver", PicoLight, 05000394 Rev 3, Apr. 2002, p. 1–3, 13, 14, no date.
"New Optical Transceivers Compatible with Infiniband Communication Standards", Stratos Lightwave, Feb. 5, 2002.
"1 Gbps SFP Shortwave Transceiver", PicoLight, 05000398 Rev 4, Apr. 2002, p. 1–3, 12, 13, no date.
"Adapter, HSSDC2 to SFP", Molex Incorporation, Jun. 15, 2001, p. 1–3.

(Continued)

*Primary Examiner*—Thanh-Tam Le

(57) ABSTRACT

A small form-factor (SFP) module for insertion into an SFP cage having a spring latch is provided. The SFP module has a housing with an open ended chamber configured to accept a plug. A latch tab is formed on and projects outward from a wall of the housing. The latch tab securely engages the spring latch when the SFP cage and module are engaged with one another. The SFP module also includes a pull release mounted to the housing which is slidable along a range of motion. The pull release has a release member extending outward from a body. The release member moves along a side of the latch tab to a fully released position to disengage the spring latch from the latch tab.

18 Claims, 10 Drawing Sheets

OTHER PUBLICATIONS

"Agilent HFBR–5720AL/5720ALP/Fibre Channel 2.125/1.0625 GBd 850 nm/Small Form Pluggable Low Voltage (3.3V)/ Extended Temperature and Extended Operating Voltage ($V_{cc}$± 10%, Temperature –20 to 85° C.) Optical Transceiver Data Sheet", Agilent Technologies, May 28, 2002, p. 1–3, 15–17.

"OC–48 Small Form Pluggable Transceiver", C–13–2500–SFP–SLCA, Luminent, Inc., 2002, no date.

"OC–48 Small Form Pluggable Transceiver (3.3V)", C–1x–2500–SFPD–SLC2, Luminent, Inc., 2002, no date.

"NetLight® Small Form–Factor Pluggable (SFP) Transceiver", Agere Systems, Aug. 2001, p. 1–5, no date.

"SFP Family of 1.3 $\mu$m FP Transceivers", Luminent Inc., Press Releases, Mar. 11, 2002.

"Cooperation Agreement for Small Form–Factor Pluggable Transceivers", Small Form–factor Pluggable (SFP) Transceiver MultiSource Agreement (MSA), Sep. 14, 2000, p. 7–8, 12–19.

* cited by examiner

SMALL FORM-FACTOR TRANSCEIVER MODULE WITH PULL-TO-RELEASE

RELATED APPLICATIONS

This application is related to Ser. No. 10/209,790, filed Jul. 31, 2002, titled "Electrical Connector Receptacle With Module Kickout Mechanism", and Application Ser. No. 10/147,151, filed May 16, 2002, titled "Electrical Connector Assembly Utilizing Multiple Ground Planes, the complete subject matter of which are incorporated herein by reference in their entireties.

BACKGROUND OF THE INVENTION

Certain embodiments of the present invention generally relate to electrical cable assemblies for use with high speed serial data, and more particularly, to small form-factor pluggable modules for connecting to electrical connector receptacles.

A small form-factor (SFP) module is inserted into an electrical connector receptacle and connects to a host connector which is soldered to a circuit board. The module typically includes a transceiver for either copper or fiber optic based network systems. Conventional connector receptacles may be comprised of one or two pieces. The one piece receptacle or the bottom of the two piece receptacle may be soldered to the circuit board using multiple solder pins, or may utilize press fit pins to attach the receptacle to the circuit board. The one and two piece receptacles define an internal space into which the module is inserted. A mechanical locking mechanism engages and holds the SFP module in place.

To remove the module from the receptacle, the locking mechanism must be disengaged. Several implementations have been used to disengage the locking mechanism. For example, a lever, push bar, and the like may be attached to the bottom or the top of the module. The lever may then be turned or pushed downward away from the top of the module to disengage the locking mechanism. Alternatively, a button may be located on the bottom of the module and pushed inward toward the back of the module to release the locking mechanism.

Conventional receptacles contain, one or more "kickout" springs typically located at the rear of the receptacle which apply a force against the module. When the locking mechanism is disengaged, the force induced on the module by the kickout spring is intended to assist in the removal of the module from the receptacle. Unfortunately, after multiple ejections of the module, conventional kickout spring designs often are unable to provide a sufficient force to overcome the friction and mating force of the ground contacts electrically engaging the module and receptacle. Therefore, the implementations described above may also require pulling the module from the receptacle while actuating the release mechanism.

For modules incorporating a lever, more space is required to actuate the levers. Multiple modules are often plugged into receptacles mounted close together in the same area. For example, in "belly-to-belly" or stacked designs, modules are mounted side by side and on opposed sides of the same circuit board. Therefore, the bottom, or belly, of a first transceiver is separated by the circuit board from the bottom of another transceiver. Multiple circuit boards with transceivers mounted belly-to-belly may be mounted within a chassis in a vertical or horizontal stacked configuration. Therefore, in designs utilizing belly-to-belly implementations, insufficient space may make difficult or even prevent the use of modules having levers that are pushed upward or downward. Additionally, the levers comprise more than one part and contain moving parts, such as a hinge, and may be difficult to manufacture and assemble. The complexity and moving parts contribute to a higher failure rate over the lifetime of the module as the module is ejected multiple times.

A need exists for a mechanism to disengage the SFP module from the receptacle that is easy to manufacture, assemble and operate, and which experiences a low rate of failure with repetitive use. It is an object of certain embodiments of the present invention to meet these needs and other objectives that will become apparent from the description and drawings set forth below.

BRIEF SUMMARY OF THE INVENTION

In accordance with at least one embodiment, a small form-factor (SFP) module for insertion into an SFP cage having a spring latch is provided. The SFP module has a housing with an open ended chamber configured to accept a plug. A latch tab is formed on and projects outward from a wall of the housing. The latch tab securely engages the spring latch when the SFP cage and module are engaged with one another. The SFP module also includes a pull release mounted to the housing which is slidable along a range of motion. The pull release has a release member extending outward from a body. The release member moves along a side of the latch tab to a fully released position to disengage the spring latch from the latch tab.

In accordance with at least one embodiment, an electrical module with a housing having an open end to receive a plug and a rear end insertable into a cage is provided. The housing includes a module latch on the housing configured to engage a spring latch on the cage. A pull tab is mounted on the housing and is movable along a range of motion between released and latched positions. The pull tab is freely movable along the range of motion and is unbiased toward either of the released and latched positions.

Figure 1:
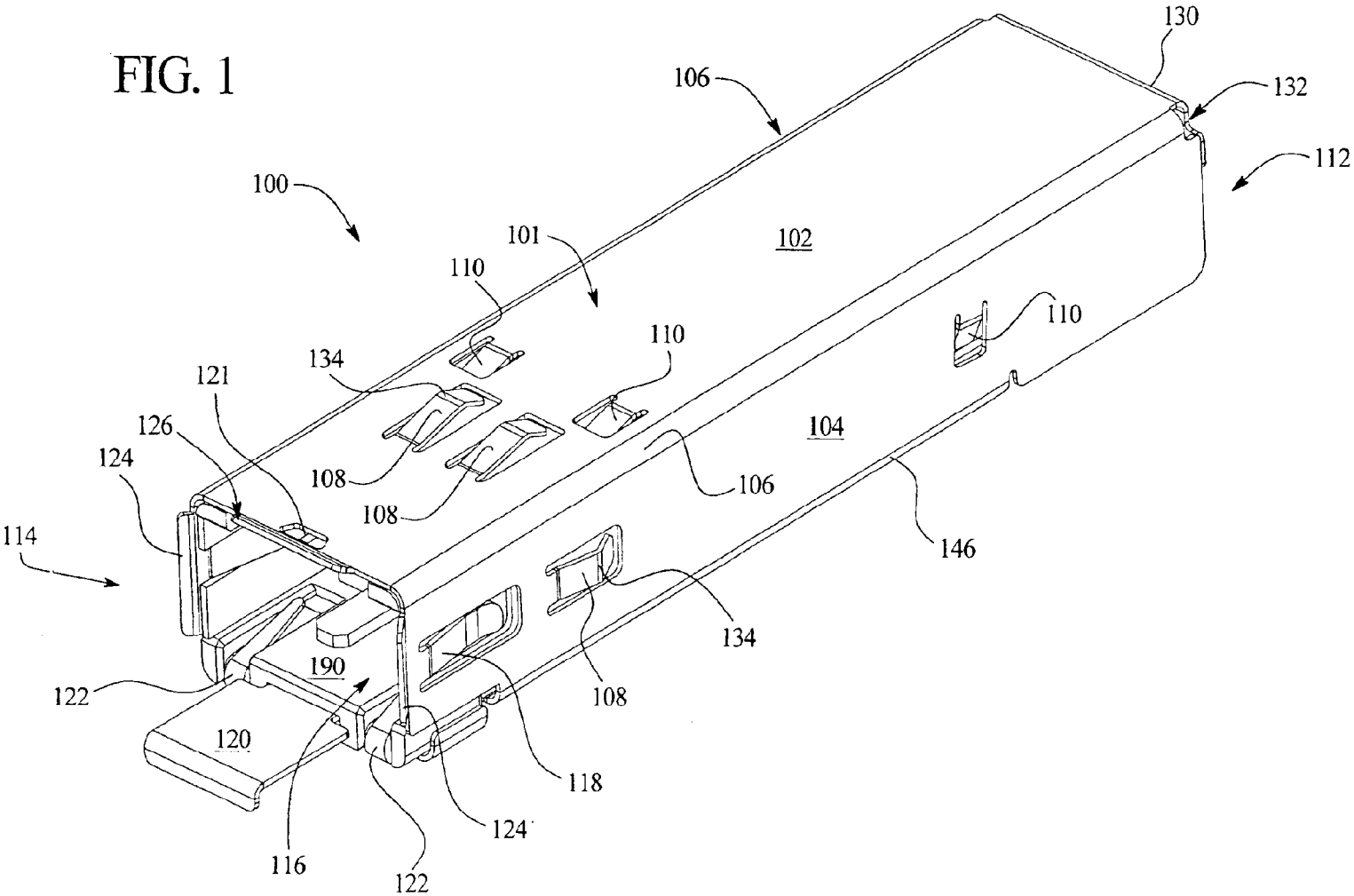
FIG. 1 illustrates a small form-factor (SFP) module with a molded housing and pull tab mounted therein formed in accordance with an embodiment of the present invention.

The foregoing summary, as well as the following detailed description of certain embodiments of the present invention, will be better understood when read in conjunction with the appended drawings. For the purpose of illustrating the preferred embodiments of the present invention, there is shown in the drawings embodiments which are presently preferred. It should be understood, however, that the present invention is not limited to the arrangements and instrumentality shown in the attached drawings.

DETAILED DESCRIPTION OF THE INVENTION

FIG. 1 illustrates a small form-factor (SFP) transceiver module 100 with a molded housing 190 and pull tab 120 mounted therein. The shell 101 of the SFP module 100 may be formed from a single piece of sheet material. The housing 190 forms an interior chamber 116 accessible through an open front end 114 through which an electrical plug 240 (FIG. 9) may be inserted.

Figure 2:
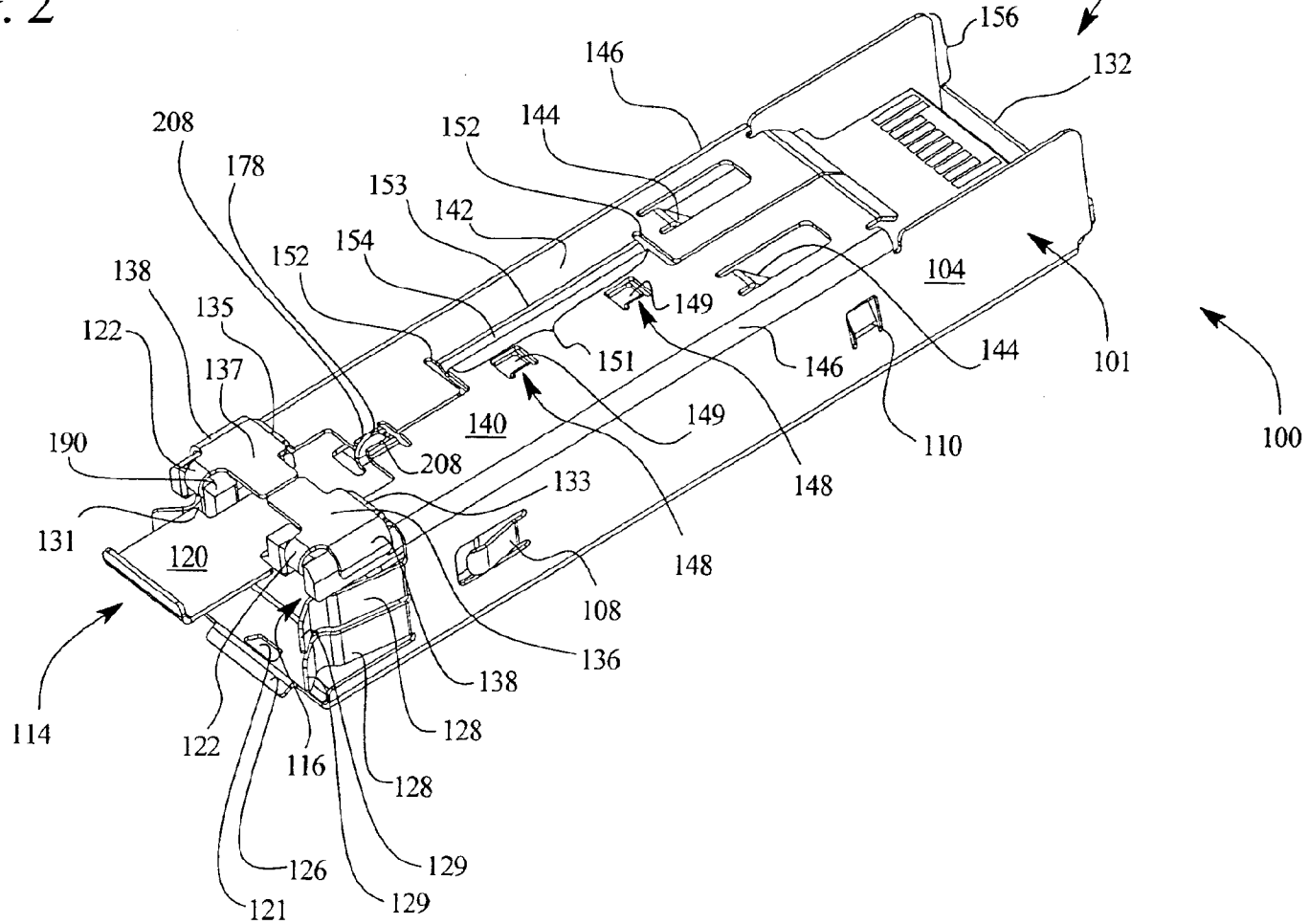
FIG. 2 illustrates a bottom view of an alternative SFP module.

FIG. 2 illustrates a bottom view of an alternative SFP module 100 with housing 190 and pull tab 120 mounted therein. FIGS. 1 and 2 will be discussed together.

The shell 101 is stamped from one flat piece of sheet material before being bent and formed, providing a simple manufacturing process. The shell 101 includes a top wall 102 and two side walls 104. The sheet material is bent along top edges 106 between the top wall 102 and the side walls 104. The top wall 102 is bent along the back edge 130 to form a partial back wall 132. Partial back wall 132 may not extend to cover the entire rear end 112, thereby leaving a window 156 open at the bottom to allow a transceiver board 150 to connect with a host connector (not shown). Side walls 104 are bent along bottom edges 146 to form bottom portions 140 and 142. Proximate the open front end 114, the bottom portions 140 and 142 are bent outward and then inward to form intermediate sections 133 and 135 and housing retaining portions 136 and 137, respectively. The outer sides of the housing retaining portions 136 and 137 are bent upward and inward to form housing retaining edges 138. The front edges of the housing retaining portions 136 and 137 are bent upward and into the interior chamber 116 of the housing 190 to form ground members 122. Ground members 122 form an electrical connection between the shell 101 of the SFP module 100 and the electrical plug 240.

Figure 6:
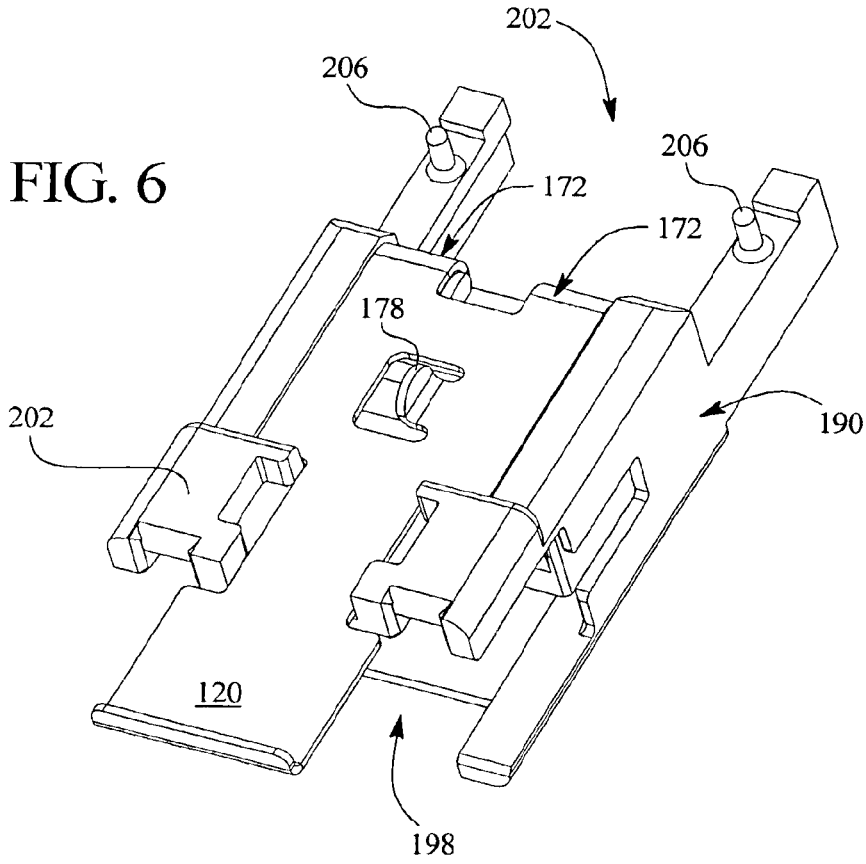
FIG. 6 illustrates a bottom view of the molded housing of FIG. 5 with the pull tab of FIG. 4 interconnected therewith.

In FIG. 1, leading edges 124 and 126 are formed proximate the open front end 114. The leading edges 124 and 126 are formed integral with side walls 104 and top wall 102, respectively, and are bent outward from the interior chamber 116. Alternatively, in FIG. 2, spring tabs 128 may be formed integral with side walls 104. Spring tabs 128 are bent inward toward the interior chamber 116 to form intermediate portion 131, then outward away from the interior chamber 116 to form leading edges 129. The spring tabs 128 form a mating connection with the electrical plug 240 at intermediate portion 131. Pull tab 120 interconnects with housing 190 (FIG. 6). A hole 121 is formed proximate the leading edge 126 in the top wall 102. The hole 121 interconnects with the electrical plug 240 to form a mating connection therewith.

A plurality of ground members 108 are stamped and formed integral with the top wall 102 and side walls 104. Ground members 108 are biased outward from the top wall 102 and side walls 104 to engage an SFP cage 220 (FIG. 8) at intermediate portion 134. Tabs 110 are stamped and formed integral with the top wall 102 and the side walls 104 to mechanically locate transceiver board 150 for connection with the host connector.

The interior chamber 116 may receive an electrical plug 240 through the open front end 114. The electrical plug 240 connects to the transceiver board 150 via pins 186 (FIG. 5) located in the rear portion of the housing 190. Ground members 118 are stamped and formed integral with side walls 104 to mechanically and electrically engage the electrical plug 240.

Bottom portions 140 and 142 include ground members 144 that are biased inward from the bottom portions 140 and 142 to electrically engage and push transceiver board 150 upward against tabs 110 to ensure that transceiver board 150 interfaces with the host connector at the proper location. Bottom portion 142 has shears or notches 152 stamped therein forming an intermediate section 151 between the notches 152. The intermediate section 151 is bent inward toward the top wall 102 and again away from the top wall 102 forming a ridge 153 and an inner portion 154 with exterior and interior surfaces. Bottom portion 140 has integral clasps 148 stamped therein. The inner portion 154 of bottom portion 142 has holes 149 stamped therein corresponding to the location of clasps 148.

Figure 3:
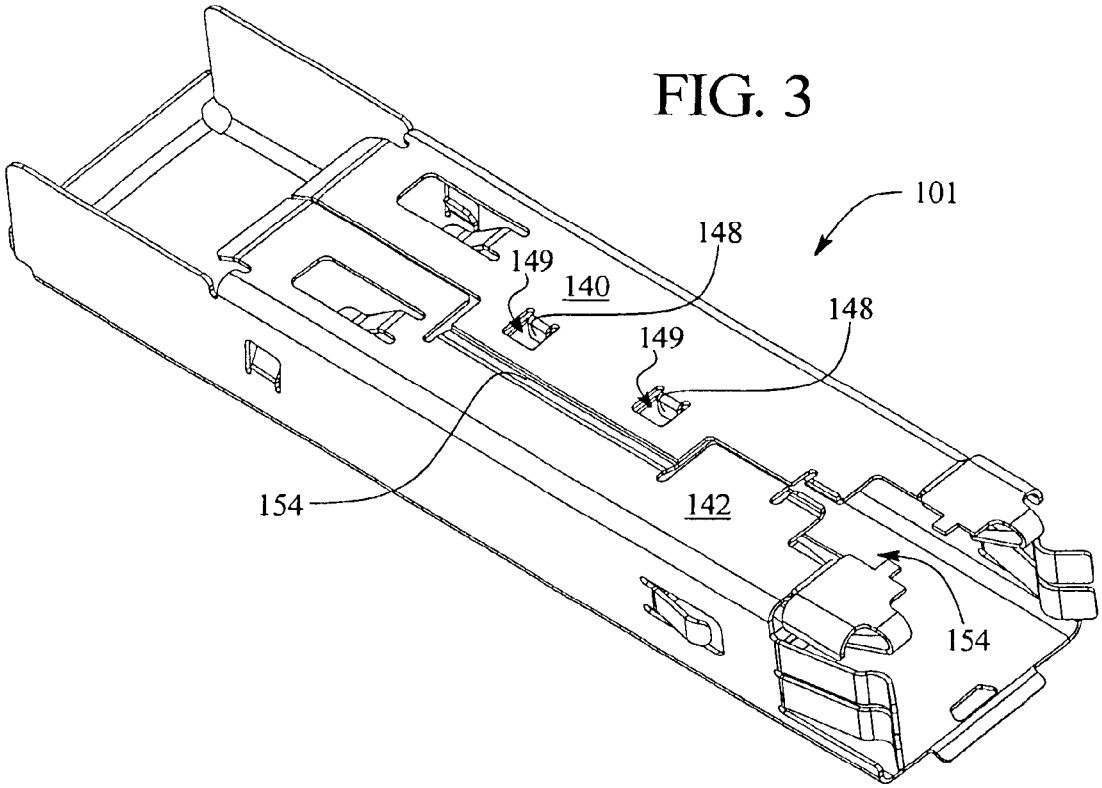
FIG. 3 illustrates a partial view of the bottom of the module shell.

FIG. 3 illustrates a partial view of the bottom of the shell 101. Bottom portion 140 overlaps the exterior surface of inner portion 154. Clasps 148 are bent inward through the holes 149 in inner portion 154, and then bent outward to clasp inner portion 154 and rest against the interior surface of inner portion 154. Therefore, a secure connection is formed between bottom portions 140 and 142 and stability is provided to the shell 101 while utilizing an uncomplicated manufacturing process. Alternatively, holes 149 may be located in different positions on inner portion 154, or holes 149 may be made a different size and/or shape, such as a rectangle. Therefore, the position, size and/or shape of corresponding clasps 148 may also be changed. Optionally, shell 101 may include a single hole 149 located on inner portion 154 with one or more corresponding clasps 148, or more than two holes 149 corresponding to two or more clasps 148.

Figure 4:
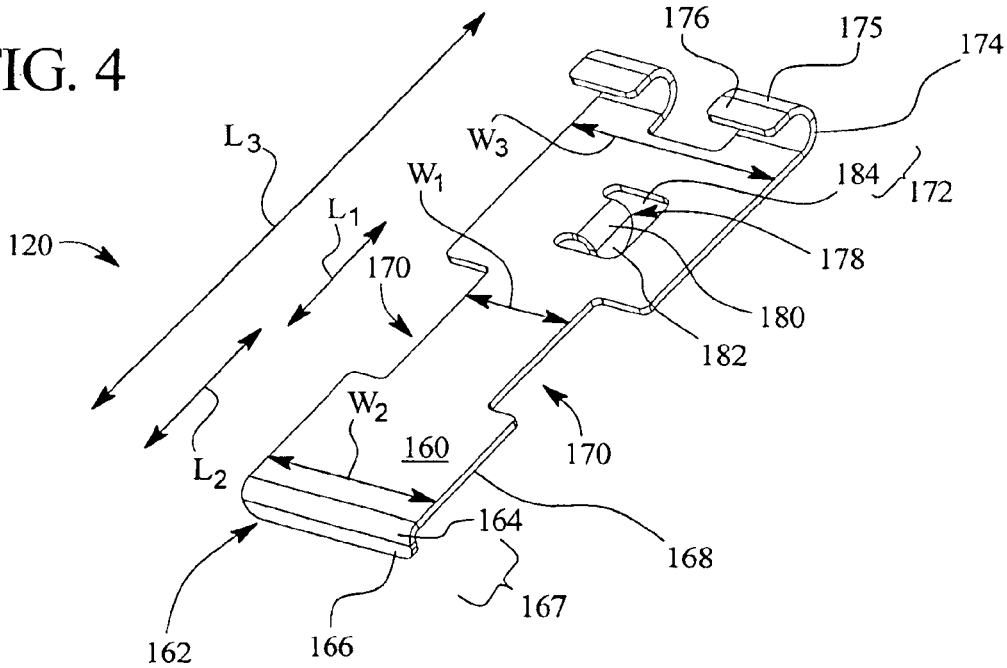
FIG. 4 illustrates a top view of a pull tab formed in accordance with an embodiment of the present invention.
Figure 8:
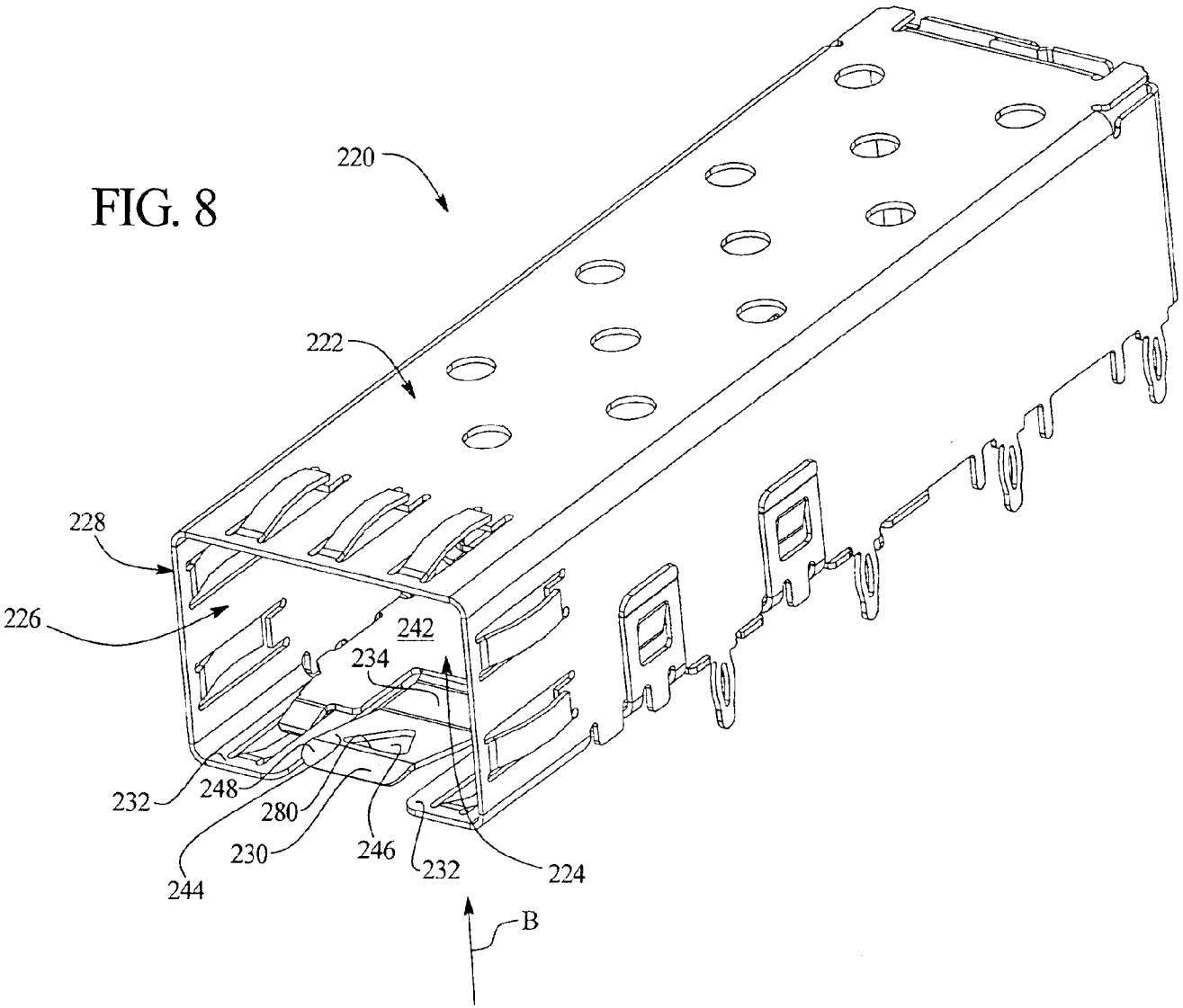
FIG. 8 illustrates an SFP cage formed in accordance with an embodiment of the present invention.

FIG. 4 illustrates a top view of the pull tab 120 used to remove the SFP module from an SFP cage 220 (FIG. 8). Pull tab 120 may be stamped and formed from a single piece of sheet material. The front edge 162 is bent to form an intermediate portion 164 and a rounded end portion 166, providing a hook or handle portion 167 which is easily grasped and pulled by hand or a tool. A flat plate 160 is formed to occupy a single plane. Flat plate 160 includes side edges 168 and notches 170 on opposite sides thereof. Back clasps 172 are bent and formed integral with the flat plate 160. Back clasps 172 are comprised of integral intermediate curves 174 and 175 and end portions 176, and are substantially U-shaped. The back clasps 172 interconnect the pull tab 120 with the SFP module 100, and provide a force on the SFP module 100 when the pull tab 120 is pulled in a direction away from the SFP module 100. Alternatively, back clasps 172 may be a single clasp 172 extending the width of pull tab 120, or a single clasp 172 located in the center of the back end of pull tab 120.

A release tab 178 is stamped and formed integral with the flat plate 160 proximate back clasps 172. Release tab 178 comprises an intermediate portion 180 and a rounded protrusion 182. As explained below in more detail, when the pull tab 120 is pulled in an outward direction, the release tab 178 releases the locking mechanism when the SFP module 100 is mounted in the SFP cage 220. Hole 184 is stamped in flat plate 160. The size of hole 184 may vary due to manufacturing accessibility and the material used to form pull tab 120.

Figure 5:
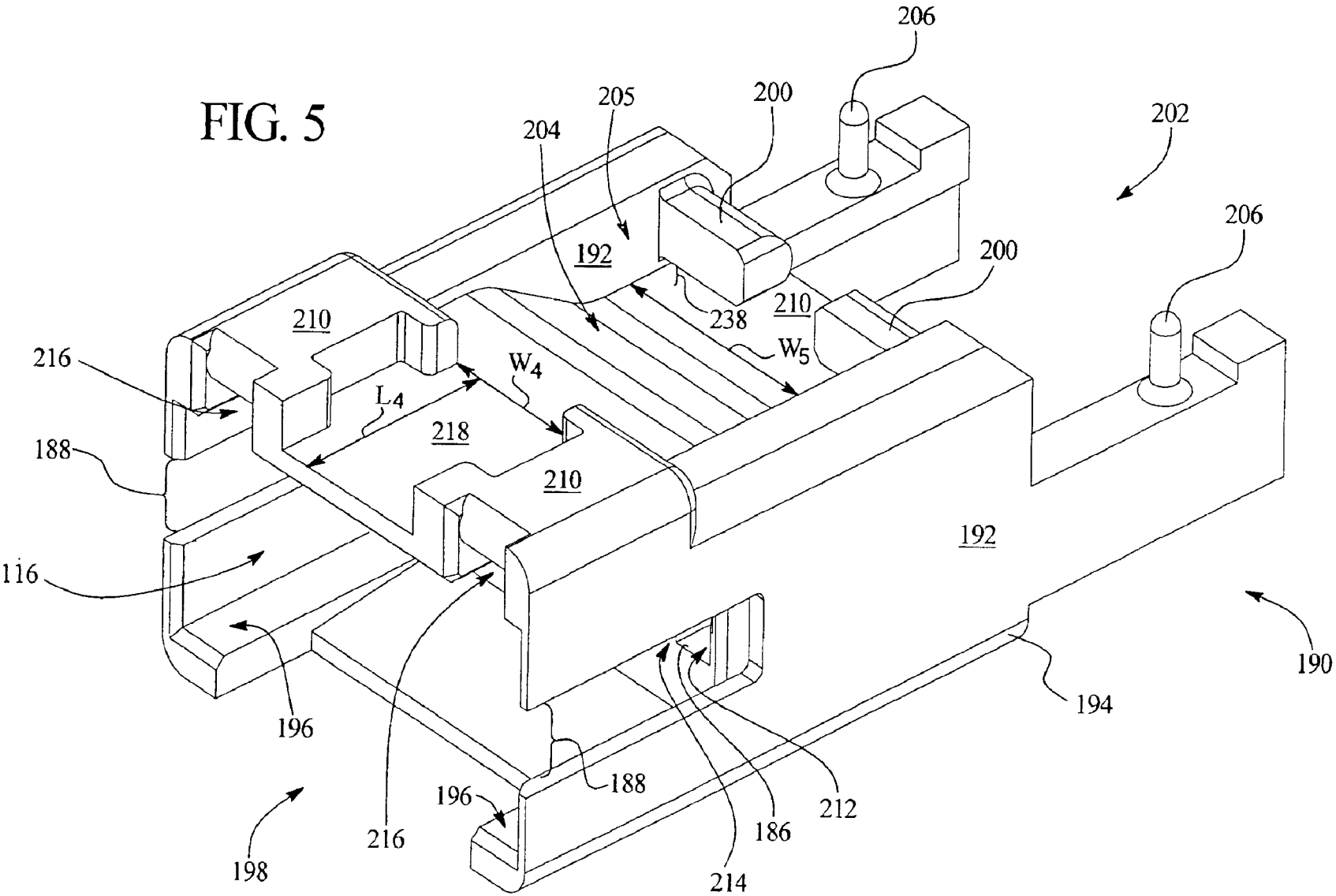
FIG. 5 illustrates a bottom view of a molded housing formed in accordance with an embodiment of the present invention.

FIG. 5 illustrates a bottom view of the molded housing 190. As discussed previously, the housing 190 is mounted inside the front portion of the SFP module 100 and includes pins 186 to interconnect the electrical plug 240 and transceiver board 150. Posts 200 and knobs 206 are located proximate the rear end 202 of the housing 190. Knobs 206 work with tabs 110 and ground springs 144 of the shell 101 to properly locate transceiver board 150. Knobs 200 project inward from each side wall 192 toward the opposite side wall 192. An open space 238 is provided below the knobs 200 to accept the back clasps 172 (FIG. 4) of pull tab 120. Although two knobs 200 are illustrated in FIG. 5, it should be understood that one bar extending from one side wall 192 to the other side wall 192 while still incorporating the open space 238 may be utilized. Alternatively, one knob 200 projecting from a single side wall 192 toward the opposite side wall 192 may be used. Posts 200 interface with pull tab 120 to restrict the amount of forward movement of pull tab 120.

Top wall 196, side walls 192, bottom wall 210, and back wall 214 form the interior chamber 116. Bottom wall 210 includes two narrow grooves 216 on either side that are cut away from the interior chamber 116, and one wide groove 218 in the middle of bottom wall 210 cut towards the interior chamber 116. The back wall 214 includes a plug receiving opening 212 therein that accepts the front edge of a circuit board (not shown) that is connected to the electrical plug 240. The opening 212 includes a plurality of projections 214 extending downward from an upper edge of the opening 212 to define recessed slots in which contact pins 186 are mounted. The contact pins 186 frictionally engage contact pads on the circuit board when the electrical plug 240 is inserted into the interior chamber 116. Notches 188 are cut in each side wall 192 near the front end 198. The notches 188 allow ground members 118 and/or spring tabs 128 of shell 101 to form an electrical connection with the electrical plug 240. Therefore, the size of notches 188 may vary depending upon the shell 101 being utilized.

Bottom wall 210 includes a ramp 204 which forms a cavity 205 interior to side walls 192. By including the ramp 204 and cavity 205, the thickness of the housing 190 is more uniformly maintained. Additionally, the cavity 205 accommodates a push button type release mechanism, allowing housing 190 to be used for multiple release implementations.

FIG. 6 illustrates a bottom view of the housing 190 with the pull tab 120 interconnected therewith. The back clasps 172 hook over the back ends of posts 200 on the housing 190 and the end portions 176 extend into the open spaces 238. The pull tab 120 is not biased toward either the front end 198 or rear end 202 of housing 190. The following discussion will reference FIGS. 4–6.

As previously discussed, pull tab 120 includes notches 170 configured such that the width $W_1$ is less than the widths $W_2$ and $W_3$. The widths $W_2$ and $W_3$ are greater than width $W_4$ of wide groove 218. Length $L_1$ of the center section of pull tab 120 is longer than length $L_4$ of wide groove 218. Lengths $L_1$ and $L_4$ may determine the allowed range of motion when the pull tab 120 is exercised. Length $L_3$ may be determined by the distance the release tab 178 travels when releasing the SFP module 100 from the SFP cage 220, and the distance the back clasps 172 may travel towards the rear end 202 of the housing 190 without interfering with transceiver board 150 or the host connector, and the desired distance that the handle portion 167 of the pull tab 120 may extend beyond the SFP module 100 when inserted into the SFP cage 220 without interfering with the electrical plug 240 and/or other installations, such as in the belly-to-belly installation as discussed previously, while still providing adequate access for the user to grasp and actuate the pull tab 120.

Figure 7:
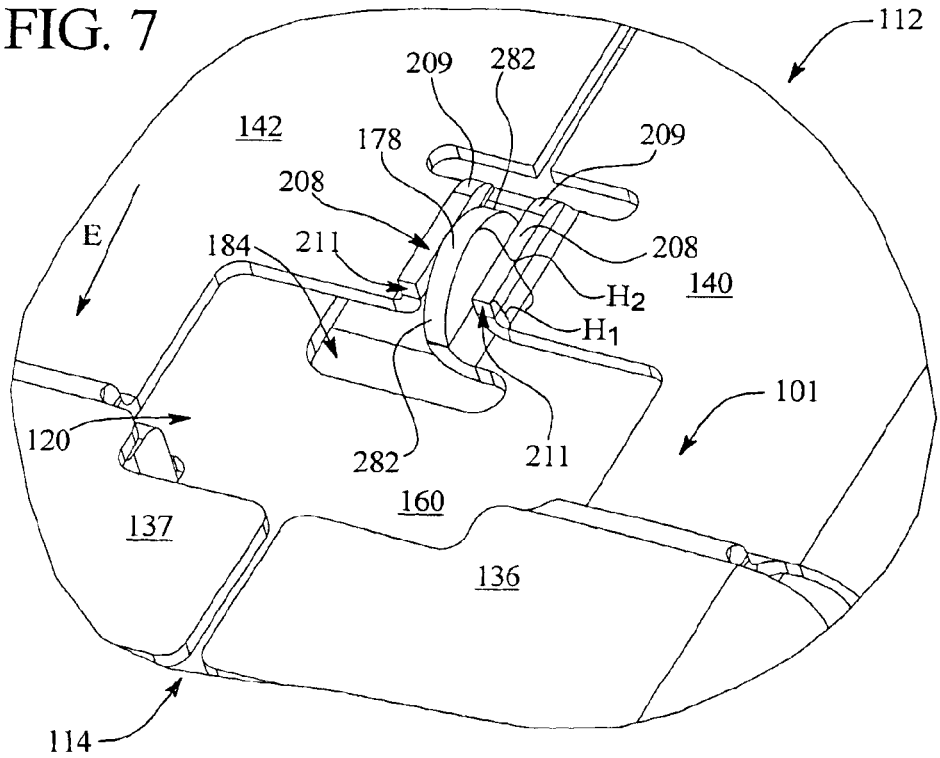
FIG. 7 illustrates a bottom view of a portion of the shell and the pull tab formed in accordance with an embodiment of the present invention.

FIG. 7 illustrates a bottom view of a portion of the shell 101 and the pull tab 120. The latch tabs 208 form the locking mechanism to maintain the SFP module 100 and SFP cage 220 engaged with one another. Release tab 178 disengages the SFP module 100 from the spring latch 230 of SFP cage 220.

FIG. 8 illustrates an SFP cage 220 that securely receives the SFP module 100. The SFP cage 220 comprises an upper shell 222 and a lower shell 224 that are mated to define a module retention chamber 226. The module retention chamber 226 is accessible through an open front end 228. Lower shell 224 includes a spring latch 230 located between base portions 232 of upper shell 222.

The spring latch 230 protrudes from the front edge of the lower shell 224 and snappably engage the release tab 178 when the SFP module 100 is inserted into the cage 220. The spring latch 230 is bent at its base to form a plateau 234. The plateau 234 occupies a plane parallel to, and slightly below, the plane of the bottom wall 242 relative to the module retention chamber 226. Forward of the plateau 234, the spring latch 230 is bent up into the module retention chamber 226 to form an intermediate portion 244 with a triangular shaped cutout 246 therein. The cutout 246 has a front edge 280. Forward of the triangular shaped cutout 246, the spring latch 230 is bent downward at an obtuse angle to the intermediate portion 244 to form a guiding lip 248 that receives the SFP module 100.

Returning to FIG. 7, regions of the bottom portions 140 and 142 of the shell 101 are bent outward away from top wall 102 to form the latch tabs 208, which extend substantially parallel to side walls 104. Latch tabs 208 have rounded ends 209 toward the rear end 112 of the SFP module 100 and a straight end 211 toward the front end 114. The straight ends 211 may extend in a plane aligned at a substantially 90 degree angle to bottom portions 140 and 142. Latch tabs 208 protrude outward a height $H_1$ from the outer surface of bottom portions 140 and 142. The height $H_1$ is greater than the thickness of the spring latch 230. Therefore, when latch tabs 208 are engaged by the cutout 246 in spring latch 230, the straight ends 211 provide resistance against the front edge 280 of the cutout 246, and the latch tabs 208 extend beyond the outer surface of the spring latch 230, providing a secure latching connection between the SFP module 100 and SFP cage 220.

Release tab 178 projects downward away from top wall 102 between latch tabs 208, and need not touch latch tabs 208. Release tab 178 has rounded outer ends 282, and has a height $H_2$ from the outer surface of bottom portions 140 and 142 that is greater than the height $H_1$ of the latch tabs 208. When pull tab 120 is pulled in the direction of arrow E, the outer end 282 of the release tab 178 slides under the front edge 280 of the cutout 246, pushing the spring latch 230 outward, and disengaging the SFP module 100 and SFP cage 220.

Figure 9:
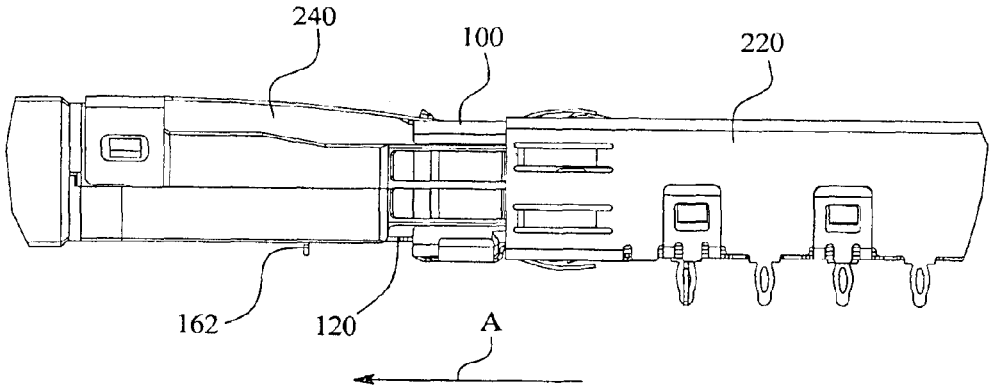
FIG. 9 illustrates a side view of the SFP cage with an SFP module and electrical plug mounted therein in accordance with an embodiment of the present invention.

FIG. 9 illustrates a side view of SFP cage 220 with a SFP module 100 and electrical plug 240 mounted therein. The pull tab 120 fits under the plug 240. The front edge 162 extends downward away from the plug 240 and thus may be easily accessed by reaching under the plug 240. The SFP module 100 may be easily removed from the SFP cage 220 by pulling the pull tab 120 in the direction of arrow A.

Figure 10:
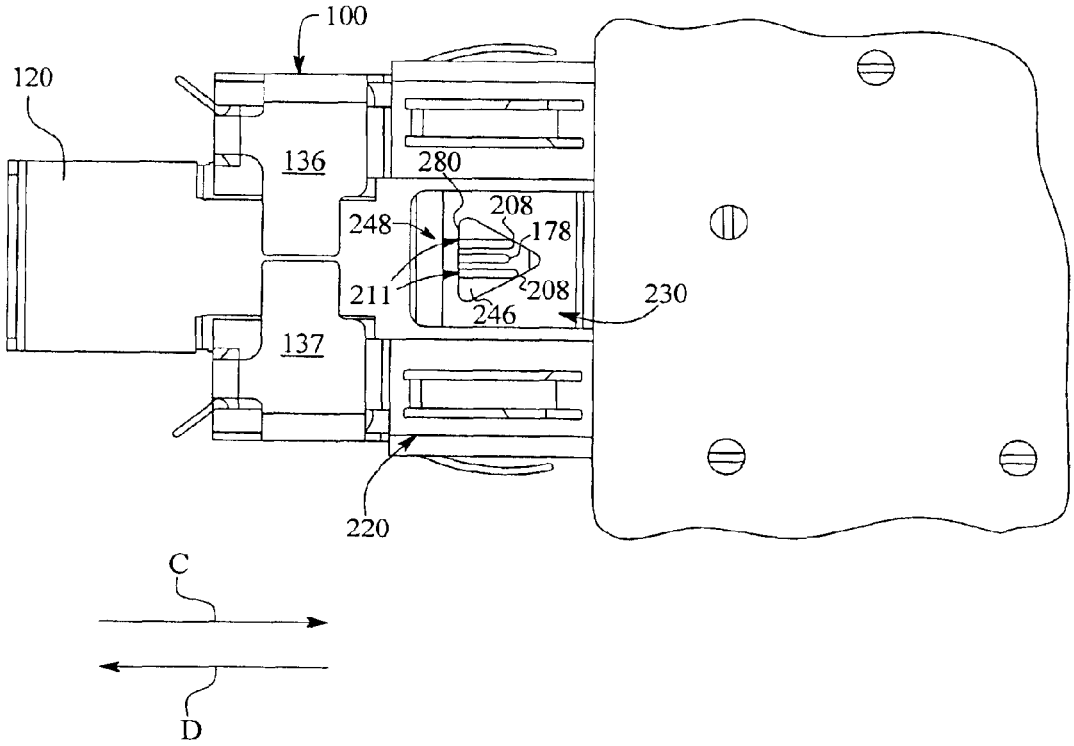
FIG. 10 illustrates a bottom view of an SFP module and SFP cage formed in accordance with an embodiment of the present invention.

FIG. 10 illustrates a bottom view of the SFP module 100 and SFP cage 220. The SFP module 100 is inserted into the SFP cage 220 in the direction of arrow C. The release tab 178 and latch tabs 208 slide over the guiding lip 248 of the spring latch 230, pushing the spring latch 230 outward. The rounded ends 209 (FIG. 7) on latch tabs 208 and outer end 282 on release tab 178 allow a smooth action between the SFP module 100 and SFP cage 220. When the SFP module 100 is fully inserted into the SFP cage 220, the spring latch 230 snaps over the release tab 178 and latch tabs 208, which now extend outward through cutout 246. The pull tab 120 is moved by the spring latch 230 to a latched position. The straight ends 211 on latch tabs 208 abut the cutout 246 and exert a force on front edge 280, and the latch tabs 208 protrude beyond the outer surface of the cutout 246 to keep the SFP module 100 and SFP cage 220 engaged.

To release the SFP module 100 from the SFP cage 220, the pull tab 120 is pulled in the direction of arrow D. As the pull tab 120 is pulled away from the SFP cage 220, the release tab 178 slides under the front edge 280 of the cutout 246, pushing the spring latch 230 outward. As the release tab 178 protrudes outward further than the latch tabs 208, the spring latch 230 is pushed outward beyond the straight ends 211 of the latch tabs 208, releasing the SFP module 100 from the SFP cage 220. The pull tab 120 is now in a released position. The SFP module 100 may be completely removed from the SFP cage 220 by continuing to pull on the pull tab 120.

Figure 11:
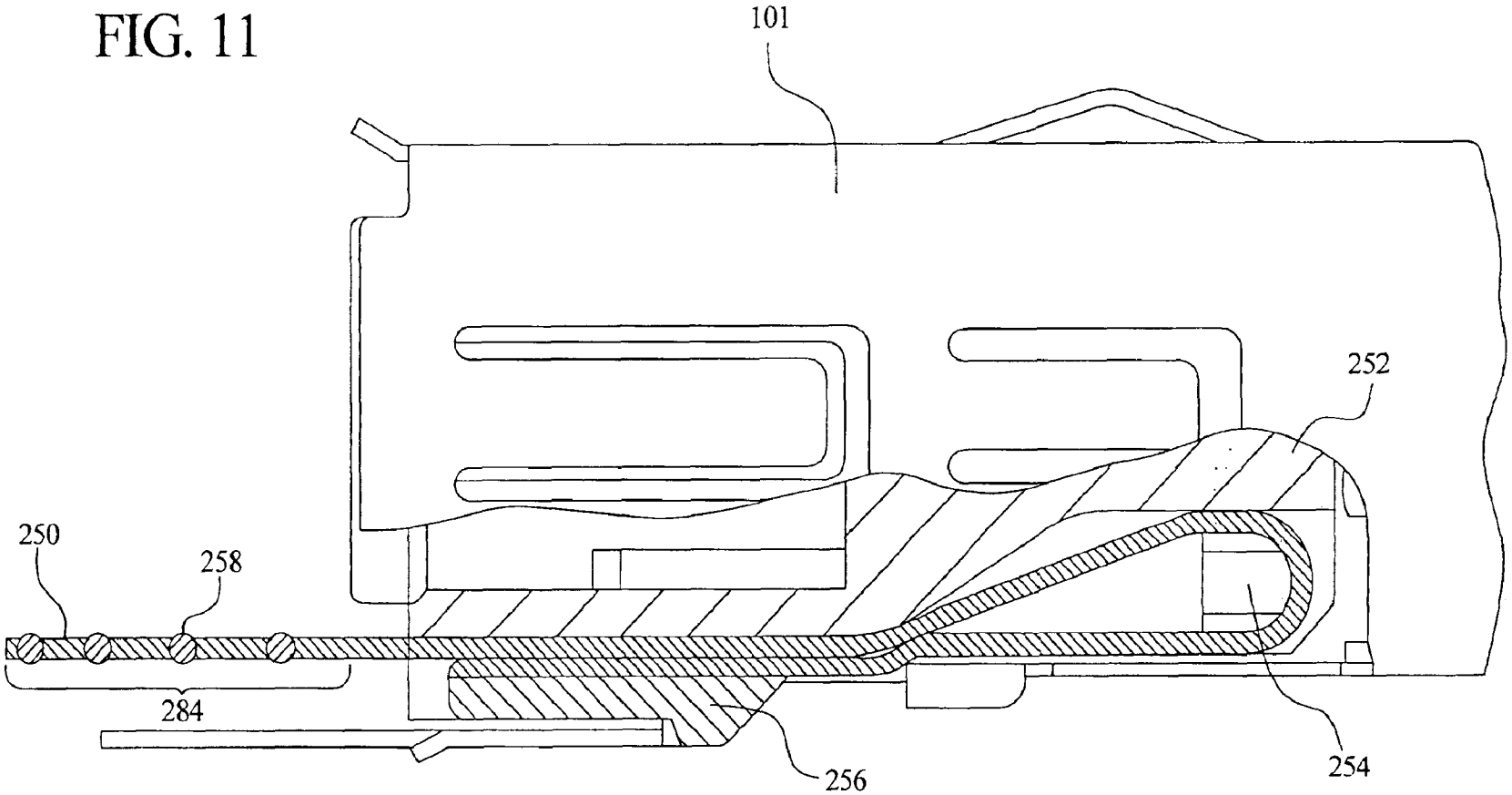
FIG. 11 illustrates a side view of an alternative pull tab and molded housing inside an SFP module formed in accordance with an embodiment of the present invention.

FIG. 11 illustrates a side view of an alternative pull tab 250 and molded housing 252 inside shell 101. The shell 101 is cutaway to illustrate the interconnection between pull tab 250 and housing 252, which may be similar to or the same as housing 190 illustrated in FIG. 6. Pull tab 250 may be a strip of pliable material and includes an integral wedge 256. The end 284 of the pull tab 250 extends beyond the shell 101 and may include a front edge 162 (as illustrated in FIG. 4) to allow a user to easily grasp the pull tab 250. Alternatively, the pull tab 250 may include small knobs 258 formed integral with end 284 to easily facilitate grasping the pull tab 250 while providing a very narrow vertical profile. The housing 252 includes a fixed pivot point 254, which may be similar to posts 200 (FIG. 3). During assembly, the pull tab 250 is looped around the pivot point 254.

Figure 12:
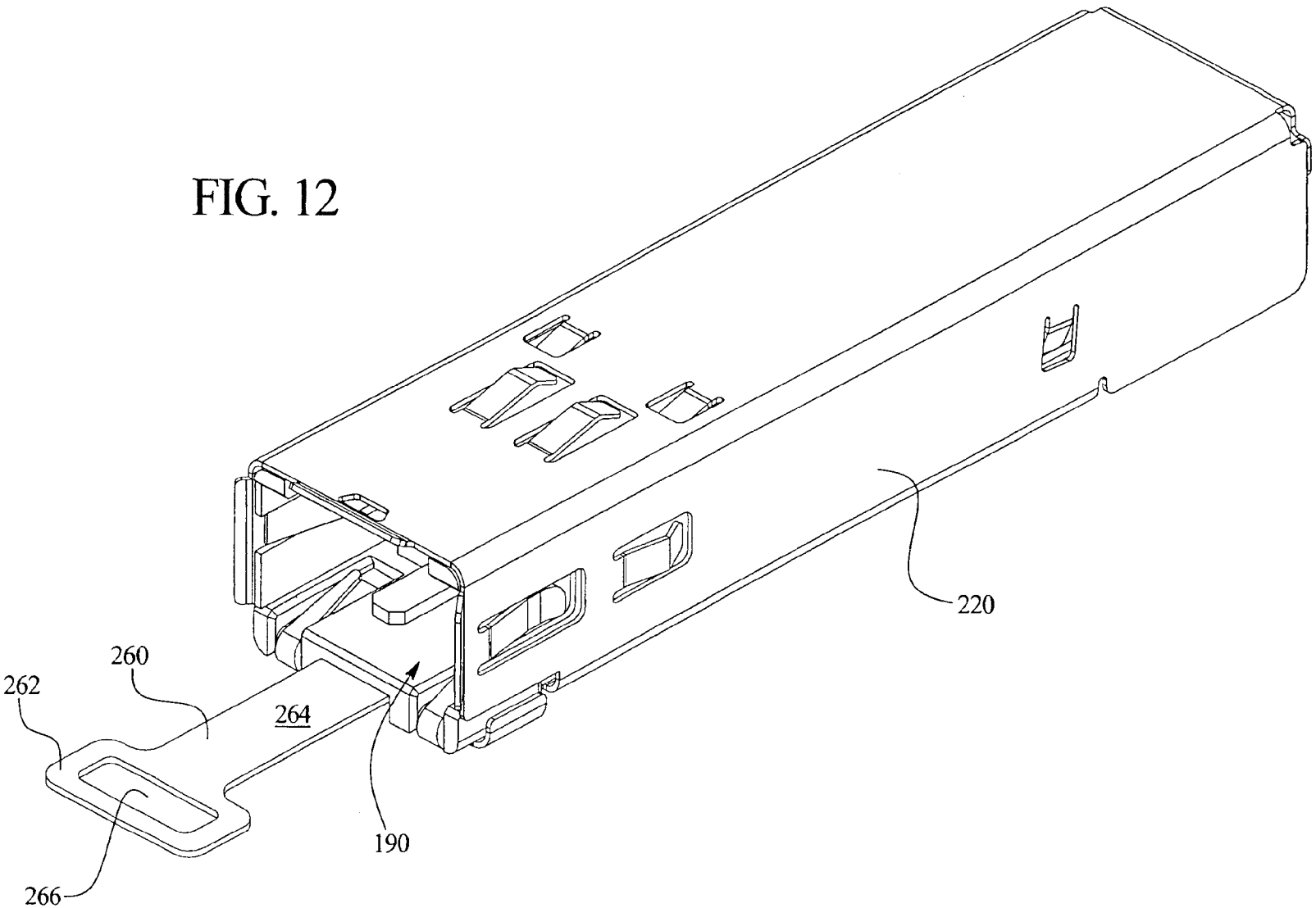
FIG. 12 illustrates an alternative pull tab installed inside a molded housing and SFP module in accordance with an embodiment of the present invention.

FIG. 12 illustrates an alternative pull tab 260 installed inside a molded housing 190 and SFP cage 220. The pull tab 260 includes an end 262 that is wider than the body 264. The end 262 includes a hole 266 to assist a user with grasping the pull tab 260. Similar to pull tab 250, pull tab 260 occupies a single horizontal plane, providing a very narrow profile.

Figure 13:
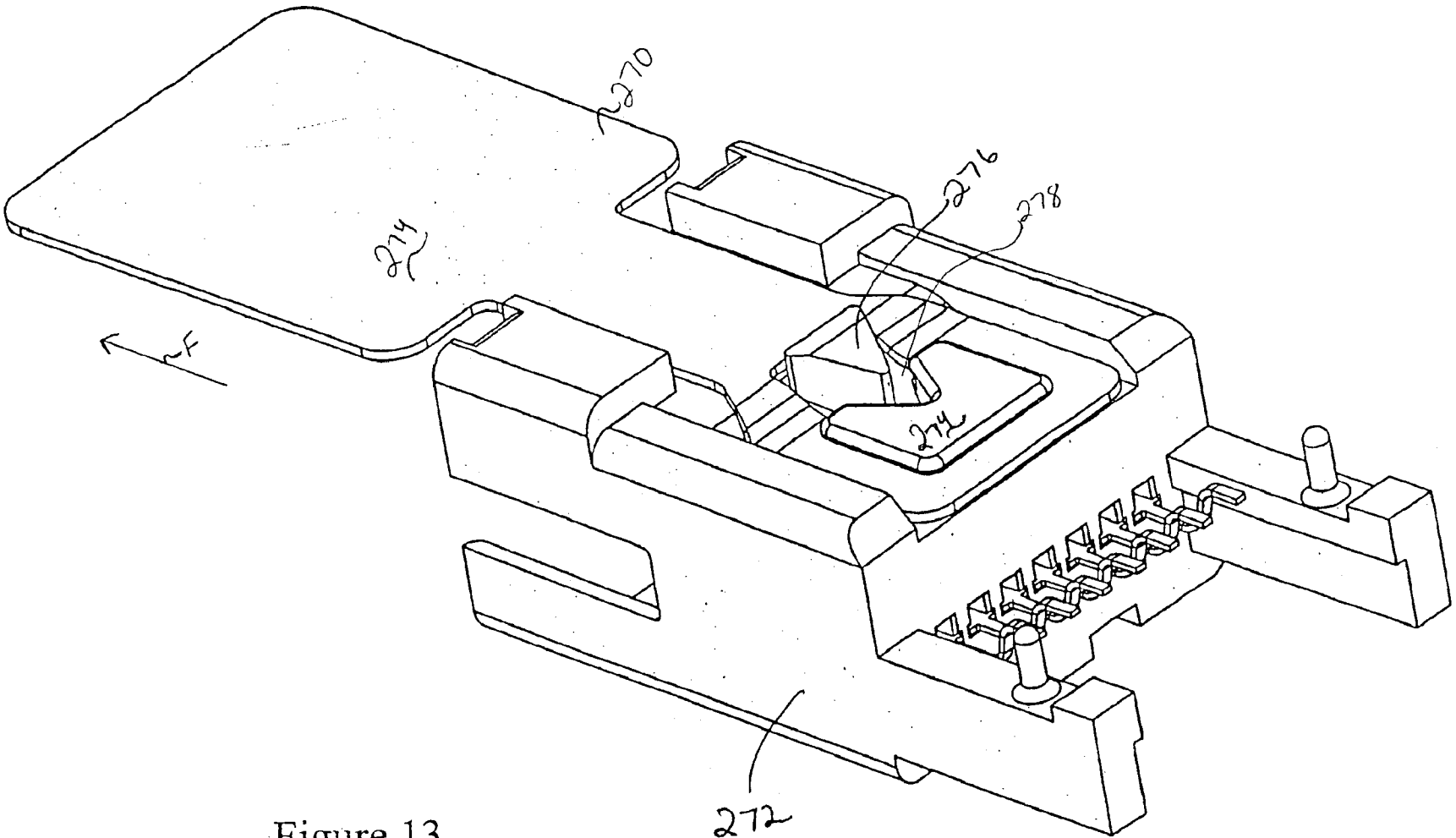
FIG. 13 illustrates a bottom view of an alternative pull tab and molded housing in accordance with an embodiment of the present invention.

FIG. 13 illustrates a bottom view of an alternative pull tab 270 and molded housing 272. Pull tab 270 includes a paddle shaped end 274 that extends beyond the installation to facilitate removal of the SFP module 100. Pull tab 270 also includes a hole 278 and a wedge 274 that is integral with, and protrudes outward from, pull tab 270. Housing 272 includes a triangular shaped knob 276 that protrudes outward through hole 278. When pull tab 270 and housing 272 are installed with transceiver board 150 and shell 101, and inserted into an SFP cage 220, knob 276 protrudes outward through the cutout 246 in spring latch 230. To disengage the knob 276 from the spring latch 230, the paddle shaped end 274 is pulled in the direction of arrow F. Hole 278 is large enough to allow the pull tab 270 to travel a short distance, allowing the wedge 274 to exert a downward pressure on the spring latch 230 to release the knob 276 from the cutout 246.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A small form-factor (SFP) module for insertion into an SFP cage having a spring latch, maid SFP module comprising:

a housing having a chamber with an open end configured to receive a plug and a rear end configured to be inserted in the SFP cage, said housing having a wall with a latch tab formed on said wall and projecting outward from said wall, said latch tab securely engaging the spring latch when the SFP cage and module are in an engaged position; and a pull release slidably mounted to said housing, said pull release having a body rigidly formed with a handle portion and a release member, said release member extending outward from said body, said release member moving along a side of said latch tab in an outward direction away from said rear end and toward said open end to a fully released position to disengage the spring latch from said latch tab, and said body including a U-shaped clasp that hooks over a knob formed on said housing when said pull release is moved to said fully released position.

2. The SFP module of claim 1, wherein said latch tab has a straight edge facing and configured to securely abut against a cutout in the spring latch.

3. The SFP module of claim 1, wherein said release member has a rounded edge facing and configured to slide along a cutout in the spring latch to disengage the spring latch from the latch tab.

4. The SFP module of claim 1, wherein maid handle portion, body and pull release slide along a common linear direction when said pull release is pulled outward from said open end along said linear direction.

5. The SFP module of claim 1, wherein said pull release resides naturally unbiased along a range of motion of said pull release.

6. The SFP module of claim 1, wherein said pull release freely moves along a range of motion of said pull release.

7. The SFP module of claim 1, wherein said release member and latch tab are aligned in adjacent parallel planes and move relative to one another.

8. The SFP module of claim 1, wherein said handle portion extends outward beyond the open end of said chamber in said housing, said handle portion being pulled to move said release member to said fully released position.

9. An electrical module comprising:

a housing having an open end configured to receive a plug and a rear end insertable into a cage;

a module latch on said housing configured to engage a spring latch on the cage; and a pull tab mounted to said housing and movable along a range of motion between a released position and a latched position, said pull tab being freely movable along said range of motion and being unbiased toward either of said released and latched positions, said pull tab having a release tab moving in an outward direction toward said open end of said housing and away from said rear end, wherein said pull tab includes a flat plate having a U-shaped clasp on one end thereof, said clasp hooking over a knob formed on said housing when said pull tab is slid to said released position.

10. The module of claim 9, wherein said module latch includes a latch tab formed on a wall of said housing and projecting outward from said wall, said latch tab securely engaging the spring latch on the cage.

11. The module of claim 9, wherein said pull tab includes a plate shaped body rigidly formed with a handle portion and with the release tab, said release tab extending outward from said body, said body, handle portion and release tab being pulled along a common linear direction to release the spring latch on the cage from said latch on said housing.

12. The module of claim 9, wherein said pull tab rests unbiased along a range of motion of said pull tab, said pull tab being moved by the spring latch on the cage to said latch position when said module is inserted into the cage.

13. The module of claim 9, wherein said housing further comprises a shell having a latch tab formed on a wall of said shell, said latch tab securely engaging the spring latch on the cage.

14. The module of claim 9, wherein said housing includes grooves slidably receiving said pull tab.

15. The module of claim 9, wherein said pull tab includes a plate shaped body and the release tab extending outward from said body, said release tab and module latch being aligned in adjacent parallel planes and moving relative to one another.

16. The module of claim 9, wherein said pull tab includes a handle portion extending outward beyond said open and of said housing, said handle portion including an end portion being bent.

17. An electrical module comprising:

a housing having an open end configured to receive a plug and a rear end insertable into a cage;

a module latch on said housing configured to engage a spring latch on a cage; and a pull tab mounted to said housing and movable along a range of motion between a released position and a latched position, said pull tab being freely movable along said range of motion and being unbiased toward either of said released and latched positions, said pull tab having a release tab moving in an outward direction toward said open end of said housing and away from said rear end, said pull tab includes a flat plate having a clasp on one end thereof, said clasp being bent to wrap a partial distance around a knob formed on said housing.

18. The module of claim 9, wherein said pull tab includes a body and the release tab extending outward from said body, said release tab and module latch being aligned in adjacent parallel planes, said release tab extending beyond said module latch.

* * * * *